US005961366A

United States Patent [19]

Wei

[11] Patent Number: 5,961,366

[45] Date of Patent: Oct. 5, 1999

[54] YO-YO HAVING CLUTCHING DEVICE

[76] Inventor: Ho-Sheng Wei, No. 14, Lane 189, Hsinyi Rd., Luchou Hsiang, Taipei Hsien, Taiwan

[21] Appl. No.: 09/013,059

[22] Filed: Jan. 26, 1998

[51] Int. Cl.[6] ..... A63H 1/30

[52] U.S. Cl. ..... 446/250

[58] Field of Search ..... 446/250, 249, 446/248, 247, 251, 252, 242, 236

[56] References Cited

U.S. PATENT DOCUMENTS

| | | | |
|---|---|---|---|
| 2,739,419 | 3/1956 | Cleveland | 446/242 |
| 3,971,158 | 7/1976 | Hanson | 446/242 |
| 4,332,102 | 6/1982 | Caffrey | 446/250 |
| 5,100,361 | 3/1992 | Kuhn et al. | 446/250 |
| 5,184,972 | 2/1993 | Tomberlin | 446/250 |
| 5,769,686 | 6/1998 | Duncan et al. | 446/250 |

*Primary Examiner*—D. Neal Muir
*Attorney, Agent, or Firm*—Smith, Gambrell & Russell, LLP; Beveridge, DeGrandi, Weilacher & Young Intellectual Property Group

[57] ABSTRACT

The present invention relates to an improved yo-yo wherein a clutching device is disposed between the shaft and the disks such that the spinning stroke can be prolonged. The yo-yo includes first and second disks that are fixedly connected together by means of a shaft. A bushing is rotationally enveloped onto the shaft and is rotationally disposed within one of the disks. One of the disks is provided with a clutching device that is engaged with the bushing that is rotationally disposed therein by means of a resilient force. Wherein when those disks are spun, the centrifugal force generated thereof will overcome the resilient force such that the bushing will be released by the clutching device and the first and second disks and the shaft will spin independently to the bushing. When the spinning of the first and second disks and the shaft slows down, the clutching device engages the bushing again such that the bushing will spin with the first and second disks and the shaft jointly. By this arrangement, when the yo-yo is thrown downward and outward, the yo-yo will spin along the string. When the yo-yo reaches to the end of the string and by the function of the clutching device, the yo-yo will spin at the end of the string for a prolonged interval. When the spinning slows down, with the function of the clutching device, the yo-yo will spin upward along the string. By this arrangement, the player may conduct a plurality of acrobatic actions with the prolonged spinning interval.

20 Claims, 3 Drawing Sheets

YO-YO HAVING CLUTCHING DEVICE

FIELD OF THE INVENTION

The present invention relates to a yo-yo, more particularly, to an improved yo-yo wherein a clutching device is disposed between the shaft and the disks such that the spinning stroke can be prolonged. Consequently, a plurality of acrobatic movements can be manipulated.

DESCRIPTION OF PRIOR ART

The yo-yo is a toy that is configured by a pair of disks connected by a shaft. A string is attached to the shaft at one end. In playing the yo-yo, the string is first wound onto the shaft and then the yo-yo is thrown outward and downward. The yo-yo will then quickly spin down along the string quickly. When the yo-yo reaches the end of the string, the spinning direction of the yo-yo will immediately reverse and the yo-yo will then spin upward along the string again. When the ascending yo-yo reaches the upmost position or is held again by the palm of the player, the yo-yo can be thrown outward and downward again. Accordingly, the player may repeat the spinning downward and upward movement again and again.

Nevertheless, the player may only conduct a spinning downward and upward movement. This is quite simple for a skilled player and soon the yo-yo will be put aside. In order to increase the entertainment of the yo-yo, some acrobatic actions have been introduced by the skilled player, for example, rush turning, walking along, etc. However, a provision for conducting the acrobatic actions is a prolonged stroke of spinning downward and upward. Only a prolonged spinning will make those acrobatic actions, for example, halting, turning, and swinging etc., become possible. Unfortunately, in the existing yo-yo, a suitable arrangement has not been provided for increasing the spinning movement of the yo-yo along the string while avoiding an interval for spinning downward and upward that is too short to conduct such an acrobatic action. Only a very skilled player can merely conduct the acrobatic action, but not for too long and the success is quite low. The freshman can never conduct a single acrobatic action.

SUMMARY OF THE INVENTION

It is the objective of this invention to provide an improved yo-yo wherein the spinning stroke of the yo-yo along the string can be prolonged such that the player can do a plurality of acrobatic actions.

According to one aspect of the present invention, a clutching device is disposed between the shaft and the disks such that the spinning down and up movement can be prolonged. Consequently, the skilled player can manipulate a plurality of acrobatic movements.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
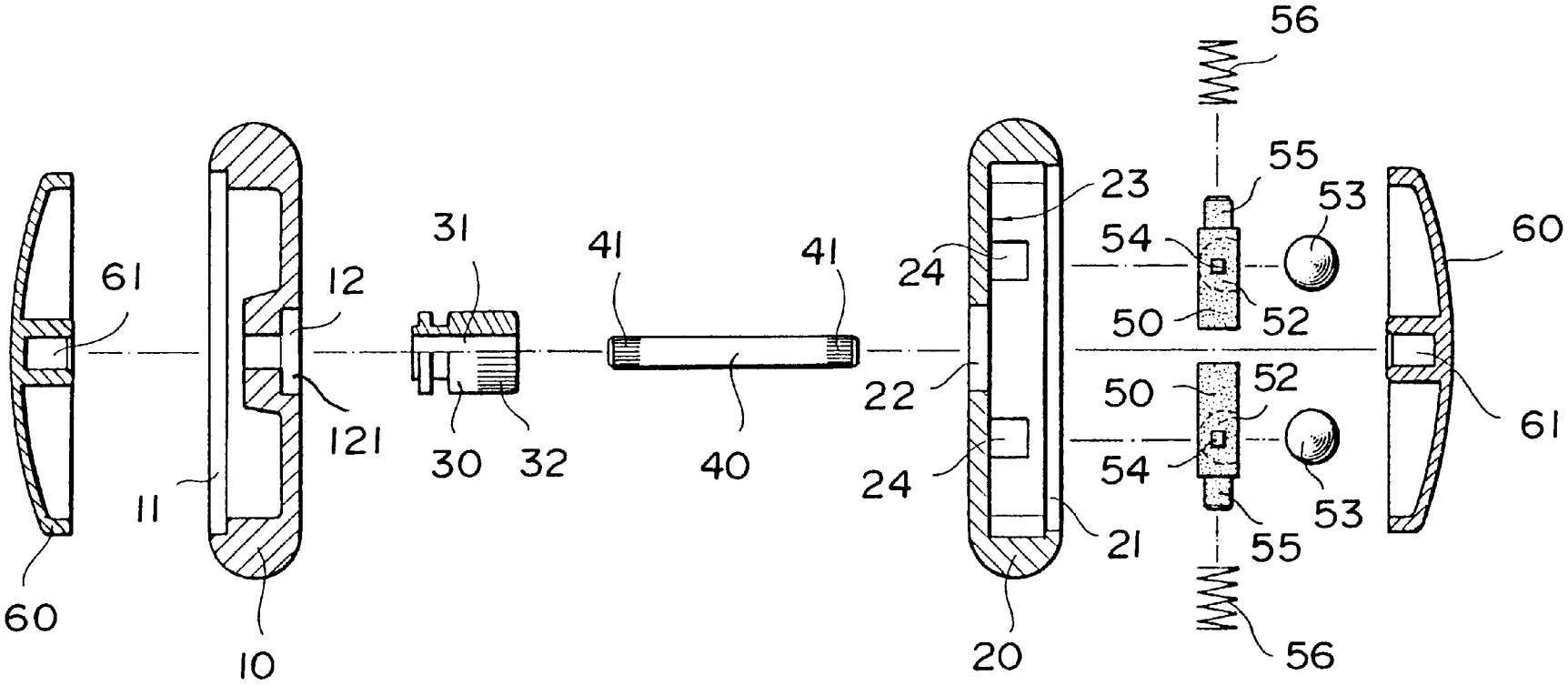
FIG. 1 is a cross sectional view of the yo-yo made according to the present invention.
Figure 3:
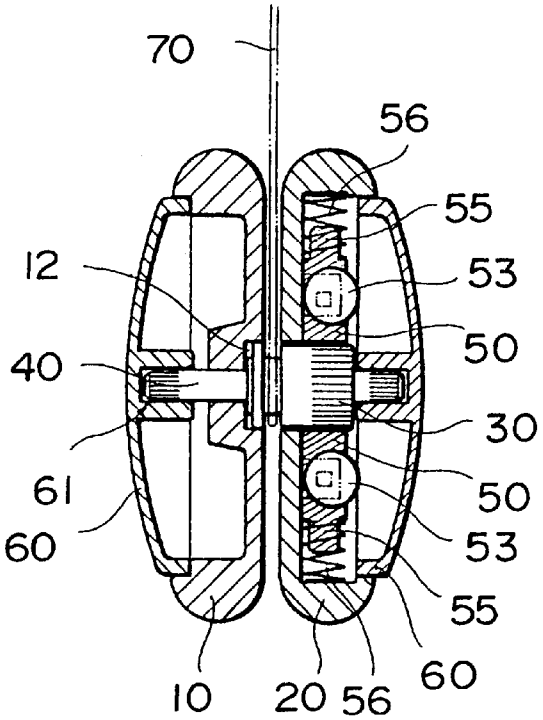
FIG. 3 is a cross sectional view of the yo-yo shown in FIG. 1.
Figure 2:
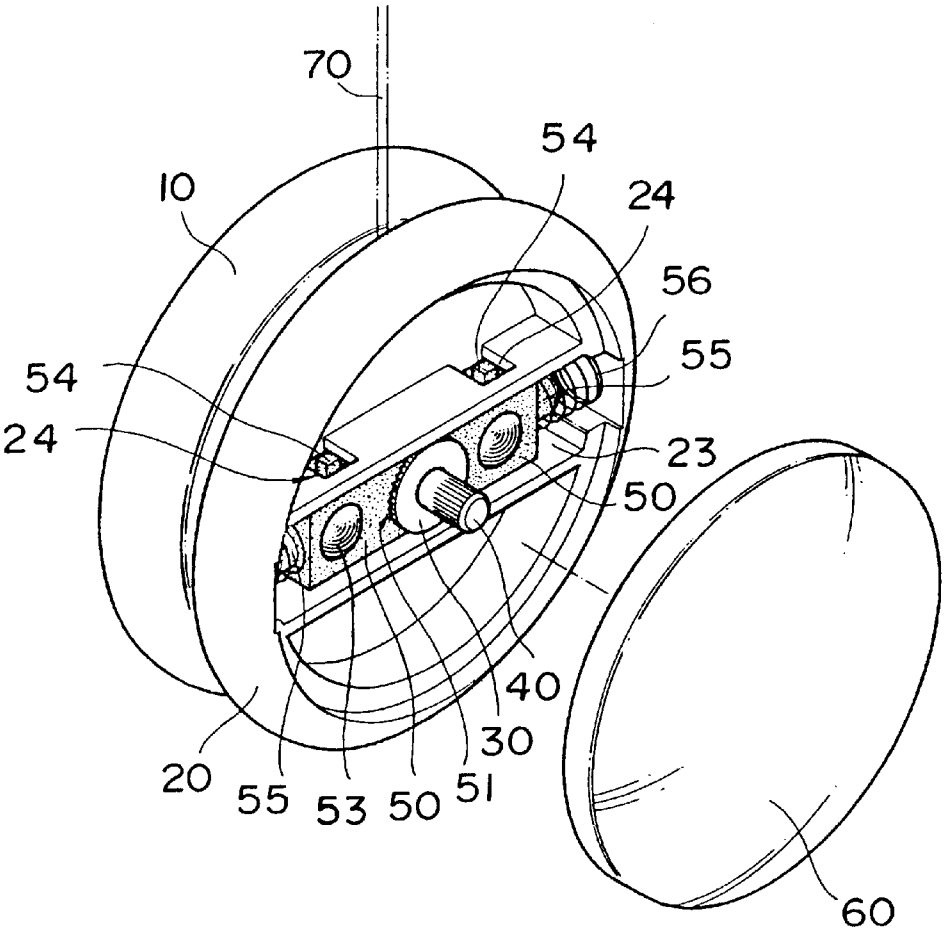
FIG. 2 is a perspective view of the yo-yo shown in FIG. 1.

Referring to FIGS. 1 to 3, the yo-yo made according to the present invention generally comprises a first disk 10, a second disk 20, a bushing 30, a shaft 40, a pair of braking rods 50 and a pair of end covers 60.

The first disk 10 has a hollow configuration and defines a mounting recess 11 at the outer surface. A shaft hole 12 that has an enlarged portion 121 is disposed centrally on the first disk 10.

The second disk 20 has a hollow configuration also and defines a mounting recess 21 at the outer surface. A bushing hole 22 is disposed centrally on the second disk 20. The second disk 20 defines a receiving groove 23 therein and the inner wall of the groove 23 is provided with a window 24 thereof. The inner diameter of the bushing hole 22 is same with the enlarged portion 121 of the shaft hole 12 of the first disk 10.

The bushing 30 can be rotationally disposed within the enlarged portion 121 of the shaft hole 12 of the first disk 10 and freely passes through the bushing hole 22 of the second disk 20. The bushing 30 has a passage 31 centrally and lengthwise. The bushing 30 further includes an embossed portion 32 adjacent to the second disk 20.

The shaft 40 can be moveably inserted into the bushing 30 through the passage 31. Both ends of the shaft 40 are provided with an embossed portion 41, respectively.

The braking rod 50 is preferably made from elastic material, for example rubber and soft PVC material. One end of the braking rod 50 is formed with a curved end surface to match the diameter of the shaft 40. This curved end surface is also provided with teeth 51. The braking rod 50 further includes a ball recess 52 for receiving a steel ball 53 therein. The ball recess 52 can be made slightly small than the steel ball 53 in dimension such that the steel ball 53 can be forcibly inserted into the ball recess 52. As the braking rod 50 is made from soft material, when the steel ball 53 is inserted, the ball recess 52 will be enlarged. Accordingly, the steel ball 53 can be fixedly retained within the ball recess 52. The braking rod 50 further includes a projection 54 opposite to the ball recess 52. The other end of the braking rod 50 is further provided with a seat 55 for mounting a biasing spring 56 thereof.

The end cover 60 can be tightly seated into the mounting recesses 11, 21 of the left and second disks 10, 20, respectively. The inner side of the end cover 60 is further provided with a shaft socket 61 that is dimensioned such that the end portion 41 of the shaft 40 can be fixedly seated therein, respectively.

Referring to FIGS. 2 and 3, the above-described components can be assembled according to the following process. The bushing 30 is freely seated into the enlarged portion 121 of the disk 10 with its left end. The right end of the bushing 30 is then freely passed through the bushing hole 22 of the second disk 20. The shaft 40 can be moveably passed into the passage 31 of the bushing 30. The end cover 60 can be fixedly seated into the mounting recess 11 of the first disk 10. On the other hand, when the end cover 60 is well seated onto the first disk 10, the end portion 41 of the shaft 40 can be inserted into the shaft socket 61 of the end cover 60. Before mounting the end cover 60 onto the mounting recess 21 of the second disk 20, the braking rods 50 shall be mounted first. The braking rod 50 is moveably disposed within the receiving groove 23 such that the curve end surface having teeth 51 is directed inward. On the other hand, the projection 54 of the braking rod 50 is disposed within the window 24 of the receiving groove 23. As a result, the displacement of the projection 24 within the window 24 will also define the stroke of the braking rod 50 radially inward and outward. Besides, the braking rod 50 can be also prevented from escaping from the receiving groove 23 by the moveable engagement between the projection 54 and the window 24. As the spring member 56 is disposed between the end wall of the receiving groove 23 and the seat 55 of the braking rod 50, the braking rod 50 is biased inward. In normal condition, the curve end surface of the braking rod 50 is tightly engaged with the embossed portion 32 of the bushing 30. After the braking rod 50 is mounted, the end cover 60 can be attached to the mounting recess 21 of the second disk 20 such that the end portion 41 of the shaft 40 is seated into the shaft socket 61 of the end cover 60.

In normal condition, the first disk 10, including end cover 60, the shaft 40, the second disk 20, including braking rod 50 and the end cover 60, are fixedly connected together while a relative rotation can be still found between the bushing 30 and the shaft 40. However, as the braking rod 50 is biased by the spring 55 such that the curved end surface of the braking rod 50 is pressed against the embossed portion 32 of the bushing 30. The friction between the curve end surface of the braking rod 50 and the embossed portion 32 of the bushing 30 will result in the shaft 30, first disk 10, and second disk 20 being tightly connected with each other.

Figure 5:
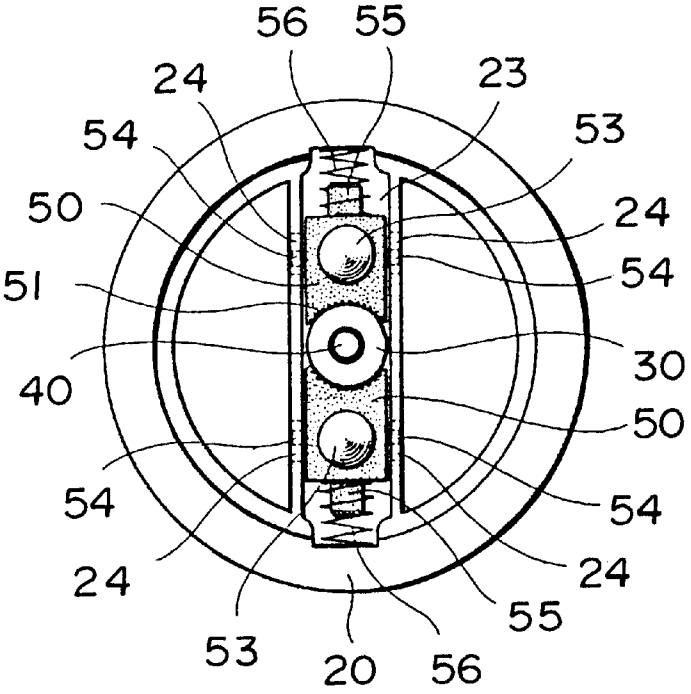
FIG. 5 is a schematic illustration showing the centrifugal force of the disks is smaller than the resilient force of the spring or the disks are still.
Figure 4:
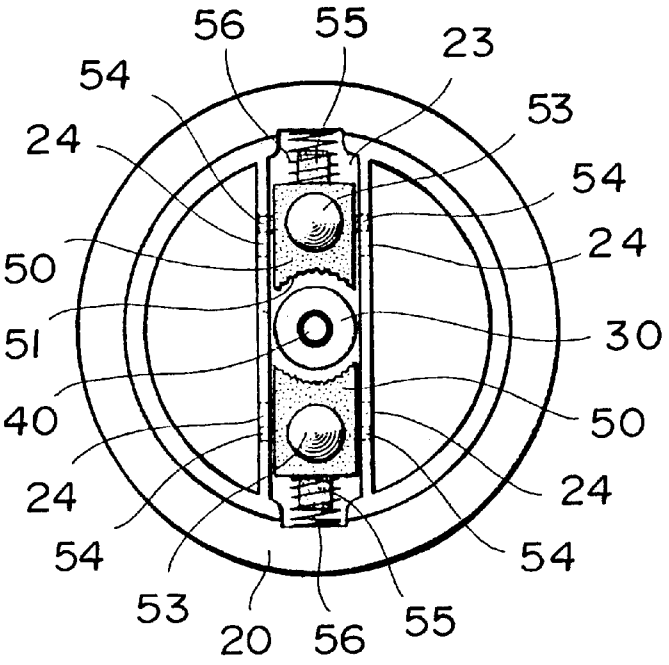
FIG. 4 is a schematic illustration showing the centrifugal force of the disks is larger than the resilient force of the spring when the disks are rotating.

As shown in FIG. 5, when the player would like to play the yo-yo made according to the present invention, a string 70 can be fixedly attached to the bushing 30 at one end. Then the player may hold the other end of the string 70 and wind the string 70 onto the bushing 30. When the string 70 is completely wound, the player may throw the yo-yo outward and downward. In this case, the yo-yo will spin downward along the string 70. During the descending and spinning movement of the yo-yo, the centrifugal force generated by the steel ball 53 of the braking rod 50 will overcome the resilient force of the spring 56. As a result, the braking rod 50 will be moved radially outward. Consequently, the embossed portion 32 of the bushing 30 will be released from the clamp of those curve end surfaces of the braking rods 50. In this case, the bushing 30 is disengaged from the disks 10, 20 and the shaft 40. Accordingly, when the yo-yo reaches to the lower end of the string 70, the disks 10, 20 and the shaft 40 will keep on spinning with respect to the bushing 30 for a prolonged interval.

When the spinning slows down, the resilient force of the spring 56 will overcome the centrifugal force of the steel ball 53 of the braking rod 50 again such that the curve end surface of the braking rod 50 is engaged with the embossed portion 32 of the bushing 30 again. In this case, the bushing 30 is engaged with the disks 10, 20 and the shaft 40 again, as clearly shown in FIG. 5. Consequently, the bushing 30 is spun with the disks 10, 20 and the shaft 40 again. Finally, the yo-yo spins upward along the string 70 again and reaches toward the hand of the player. Then the player may conduct another throw.

During the prolonged spinning of the disks 10, 20 and the shaft 40 on the lower end of the string 70, the player can conduct a plurality of acrobatic actions. Accordingly, those acrobatic actions can be readily conducted in that prolonged spinning interval.

From the forgoing description, the manipulation of the yo-yo can be fundamentally improved. As the spinning stroke or interval is prolonged, the player may conduct a plurality of acrobatic actions with sufficient time because the yo-yo will continuously spin at the end of the string 70 without ascending upward. A plurality of acrobatic actions, that the conventional yo-yo can not conduct, can be conveniently conducted by the improved yo-yo suggested by the present invention.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A yo-yo having a clutching device, comprising:

a first disk having a hollow configuration and defining a mounting recess at an outer surface of said first disk and a shaft hole that is disposed centrally on said first disk;

a second disk having a hollow configuration and defining a mounting recess at an outer surface of said second disk, a bushing hole being disposed centrally on said second disk, said second disk defining a receiving groove therein;

a bushing being rotationally disposed with respect to said first disk and freely passing through said bushing hole of said second disk, said bushing having a passage centrally and lengthwise, said bushing further including a contact surface adjacent said second disk, wherein when said bushing is disposed within said second disk, said contact surface of said bushing is disposed within said receiving groove of said second disk;

a shaft that extends through the passage of said bushing, and which has a first and a second end;

a pair of braking rods being moveably disposed within said receiving groove of said second disk, one end of each of said braking rods being formed with a curved end surface to match the contour of the contact surface of said bushing, and each of said braking rods further including a weight recess for fixedly receiving a weight therein, the other end of each of said braking rods being further provided with a spring contact portion which is in contact with a respective one of a pair of biasing springs, wherein when said braking rods are disposed within said receiving groove, said contact surface of said bushing is clamped by the curved end surface of each of said braking rods due to the resilient force from each respective spring, and said braking rods being disposed within said receiving groove both when in contact with the contact surface of said bushing and when furthest displaced from the contact surface of said bushing due to a centrifugal force effect on said weights;

a pair of end covers being received by said first and second disks, respectively, said end covers being in engagement with said first and said second shaft ends, respectively.

2. A yo-yo device as recited in claim 1, wherein an inner wall of said groove is provided with a window and each of said braking rods further includes a projection opposite to the weight recess, each said projection being linearly, moveably disposed within a respective window such that the displacement of said braking rods within said receiving groove of said second disk is limited.

3. A yo-yo device as recited in claim 1, wherein each of said braking rods is preferably made from an elastic material.

4. A yo-yo device as recited in claim 1, wherein said braking rods are arranged for displacement in linear fashion along a line extending transverse to a central axis of elongation of said shaft.

5. A yo-yo device as recited in claim 1 wherein said bushing is rotationally disposed within an enlarged portion of said shaft hole.

6. A yo-yo device as recited in claim 1 wherein the contact surface of said bushing is an embossed surface.

7. A yo-yo device as recited in claim 6 wherein the curved end of each of said braking rods includes teeth for engagement with the embossed surface.

8. A yo-yo device as recited in claim 1 wherein said braking rods are formed of a soft, elastic material which is sufficiently soft and elastic as to allow for expansion of the weight recess during weight insertion and contraction about the weight following insertion.

9. A yo-yo device as recited in claim 1 wherein each of said weights is a ball received within an undersided ball reception hole provided in each of said braking rods.

10. A yo-yo as recited in claim 1 wherein for each of said braking rods said curved end surface, weight recess and the spring contact portion are arranged in linear fashion with the weight being positioned between the curved end surface and the spring contact portion.

11. A yo-yo as recited in claim 1 wherein said receiving groove includes an internal wall surface and two elongated, side-by-side extending side walls with the internal wall surface and two elongated side walls defining an open outer end and an elongated reception and guidance area within which reception and guidance area each of said braking rods and springs are positioned for guided, linear displacement, and the open end of said groove being covered by a respective one of said end covers.

12. A yo-yo as recited in claim 1 wherein each of said end covers includes an internally extending socket for reception of a respective one of said first and second ends of said shaft.

13. A yo-yo as recited in claim 12 wherein each of said first and second ends of the shaft is embossed for improved engagement within the socket of said end covers.

14. A yo-yo as recited in claim 1 wherein each spring contact portion of said braking rods includes a spring seat mount for position retention of said springs.

15. A yo-yo as recited in claim 14 wherein each of said spring seat mounts includes a protrusion that extends internally into a hollow of a respective spring.

16. A yo-yo device, comprising:

a first disk having a shaft hole;

a second disk having a bushing hole, and said second disk having an internal surface into which said bushing hole opens and two side-by-side side wall surfaces which border said internal surface so as to define a non-covered receiving groove;

a bushing being rotationally disposed with respect to said first disk and freely passing through said bushing hole of said second disk, said bushing having a passage centrally and lengthwise, said bushing further including a contact surface adjacent said second disk, wherein when said bushing is disposed within said second disk, said contact surface of said bushing is disposed within said receiving groove of said second disk;

a shaft which extends through the passage of said bushing and is supported by end covers;

a pair of braking rods being moveably disposed within said receiving groove of said second disk, one end of each of said braking rods being formed with a curved end surface shaped for complimentary contact with the contact surface of said bushing and each of said braking rods further including a weight recess fixedly receiving a weight member therein, the other end of each of said braking rods being further provided with a spring contact portion which is in contact with a respective one of a pair of biasing springs, wherein when said braking rods are disposed within said receiving groove and not subject to a displacing centrifugal force, said contact surface of said bushing is clamped by the curved end surfaces of said braking rods due to the resilient force from each respective biasing spring, and said braking rods being disposed within said receiving groove both when in contact with the contact surface of said bushing and when furthest displaced from the contact surface of said bushing due to a centrifugal force effect on said weights;

and said braking rods and springs being positioned for linear displacement within said groove, and for each of said braking rods the weight is positioned between a respective curved end surface and spring contact portion, and said curved end surface, weight and spring contact portion of each braking rod are aligned in a linear direction of displacement.

17. A yo-yo as recited in claim 16 further wherein one of said end covers is fixed to said second disk so as to cover the open end of said groove.

18. A yo-yo as recited in claim 17 further wherein second end cover is fixed to said first disk, and said end covers being secured to a respective opposite ends of said shaft.

19. A yo-yo device as recited in claim 16 wherein said linear direction of displacement is along a line transverse to a spin axis of said bushing.

20. A yo-yo device as recited in claim 16 wherein each weight is a ball, each braking rod has teeth along the curved end surface, and the spring contact portion of each braking rod includes a protrusion which extends internally into the respective one of the pair of biasing springs.

* * * * *